United States Patent [19]

Peeler

[11] Patent Number: 5,052,248

[45] Date of Patent: Oct. 1, 1991

[54] PULL TAB CAN OPENER

[75] Inventor: Jerry W. Peeler, Vero Beach, Fla.

[73] Assignee: Himittag, Inc., Orlando, Fla.

[21] Appl. No.: 582,419

[22] Filed: Sep. 14, 1990

[51] Int. Cl.[5] ..... B67B 7/40

[52] U.S. Cl. ..... 81/3.25; 81/3.36

[58] Field of Search ..... 81/3.25, 3.27, 3.4, 81/3.55, 3.07, 3.36

[56] References Cited

U.S. PATENT DOCUMENTS

| | | | |
|---|---|---|---|
| 2,621,549 | 12/1952 | Rocereta | 81/3.47 |
| 3,572,186 | 3/1971 | Dillard | 81/3.27 |
| 3,805,643 | 4/1974 | Turner et al. | 81/3.37 |
| 3,845,675 | 11/1974 | Cook | 81/3.27 |
| 4,663,994 | 5/1987 | Hull | 81/3.27 |
| 4,712,454 | 12/1987 | Hull et al. | 81/3.27 |
| 4,774,859 | 10/1988 | Jarvis, Sr. | 81/3.27 |

*Primary Examiner*—Roscoe V. Parker
*Attorney, Agent, or Firm*—William M. Hobby, III

[57] ABSTRACT

A pull tab can opener apparatus has a base attachable to the underside of a cabinet and has a can guiding track formed on the base for guiding a can thereon. The guiding track has a pair of can side guides and a pair of can top guides for guiding a can along a predetermined path. A pull tab grab hook is movably attached to the base between the can guiding track pair of can side guides for grabbing and removing a pull tab on a can when the can is slid along the can guiding track so that a pull tab can opener can be used with one hand. The can guiding track pair of can top guides are curved in a manner to slide the tab of a can top into the pull tab grab hook. The pull grab hook is spring-loaded and has a backward stop.

6 Claims, 1 Drawing Sheet

PULL TAB CAN OPENER

BACKGROUND OF THE INVENTION

The present invention relates to pull tab can openers, especially to a pull tab can opener for opening pop top cans with one hand.

The pull tab of pop top cans have been commonly used for various types of cold drinks, especially for cola drinks and on beer cans. Pop tops have the advantage of not requiring a can opener but allowing an individual to pull the tab and thereby open the can by forming a lever which pulls a piece of the metal top loose from the can to open the can. However, the tabs on pull tab cans are formed flat against the cans and are difficult to grab without damage to the fingernails and are sometimes difficult to open. As a consequence, users typically pry out the pull rings so that it can be readily grasped and lifted in a manner to rip out and remove a severable can opening tab. There has been a long existing need for a tool or implement which lends itself to practical use in a commercial environment where large numbers of pop top cans are opened and to replace make shift implements, such as screw drivers, to catch hold of and lift the pull ring or eye at the other end of the severable tab. Various hand held implements have been suggested which are suitable for individuals, but the need exists for bartenders and other areas where large numbers of pop top cans are being served.

In the case of a commercial establishment, it is desirable to have a mounted pop top opener in which the can is held with one hand and can be inserted and pushed through to rip the tab off prior to serving the drink to a customer.

Prior U.S. Patents include the Gould U.S. Pat. No. 2,620,691 showing a bottle opening device having a track for removing a bottle cap of a different type. The Rocereta U.S. Pat. No. 2,621,549 shows an opening tool for paper cartons having a guiding track and hook. These patents, however, were issued prior to the discovery and wide use of pop top cans.

The Goldberg U.S. Pat. No. 4,120,216, the Reed U.S. Pat. No. 3,656,375, the DePooter U.S. Pat. No. 4,133,228, the Kubach Pat. No. 4,287,794 and the Miller U.S. Pat. No. 4,309,921, each show various types of pop top or pull tab opening tools. In the Bucko U.S. Pat. No. 3,724,297, a hand held pop top opener is also illustrated.

In contrast to the prior art, the present invention is directed towards a commercial pop top tab opener which is fixably mounted to the bottom of a cabinet, shelf or counter top for the rapid opening of pop top cans on a more commercial basis, and in which the user can utilize it single handedly to shove the can through the opener to open the pop top.

SUMMARY OF THE INVENTION

The present invention relates to a pull tab can opener having base with attaching means for attaching the base to the underside of a cabinet, counter top or the like. A can guide track is formed on the base for guiding a can thereon and has a pair of can side guides and a pair of can top guides for guiding a can along a predetermined path. A pair of can top guides are curved for guiding the can opening ring along a curved path. A pull tab grab hook is movably attached to the base with the pull tab can opener between the can guiding track pair of can side guides for grabbing the pull tab pull ring for removing a pull tab on a can when the can is moved along a can guiding track so that a pull tab can opener can be used with one hand. The pull tab grab hook is spring-loaded and has a forward and backward stop and is held in a bracket by the pin. The base can be attached through bores extending therethrough with screws threaded into the bottom of a cabinet or counter top.

BRIEF DESCRIPTION OF THE DRAWINGS

Other objects, features and advantages of the present invention will be apparent from the written description and the drawings in which.

DESCRIPTION OF THE PREFERRED EMBODIMENT

Figures 1, 2A, 2B, 2C, 2D, 2E, 2F, 3:
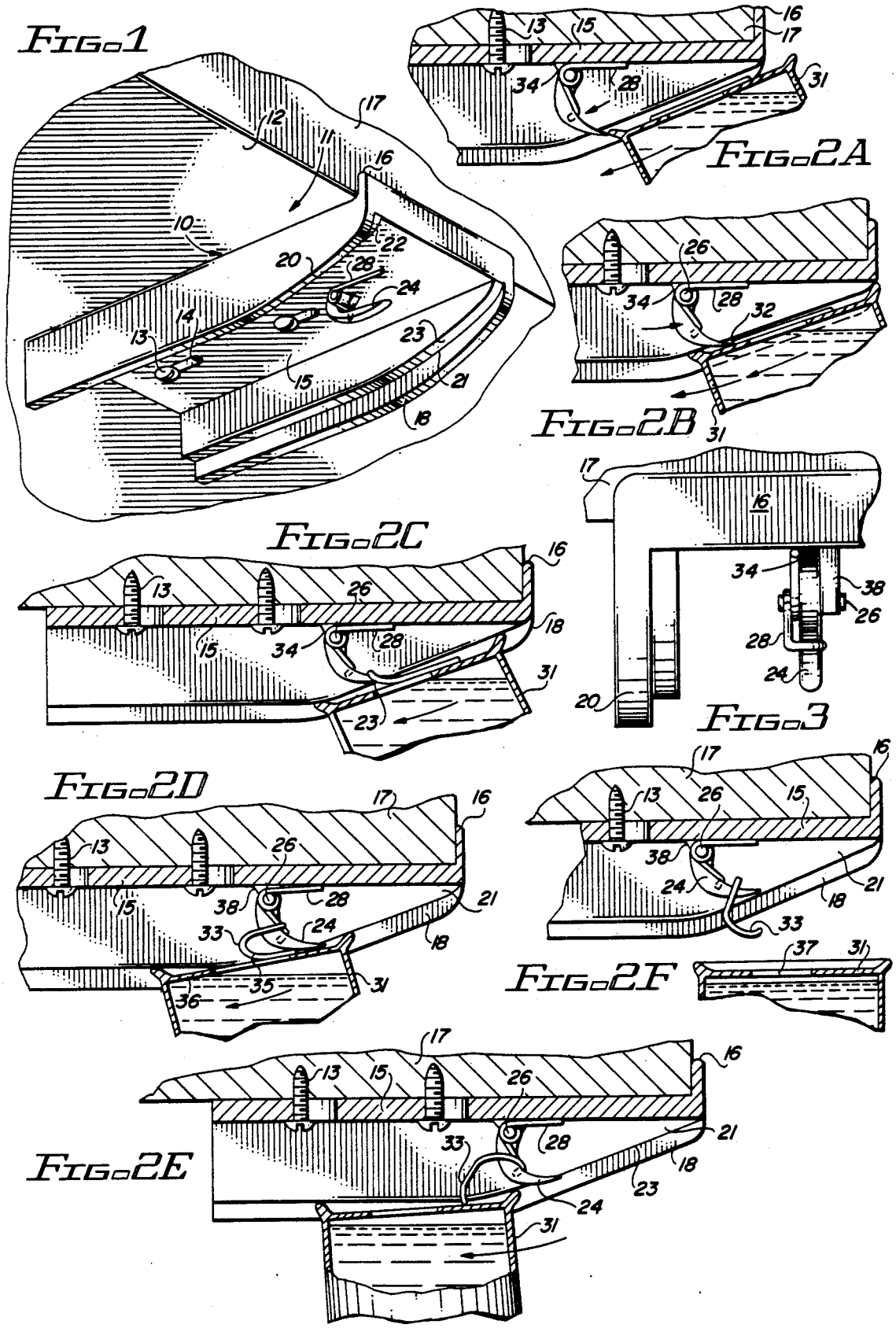
FIG. 1 is a perspective view of a pull tab can opener attached to the underside of a shelf in accordance with the present invention.
FIG. 2A through 2F are partial sectional views of the pull tab can opener of FIG. 1 having a can being shoved therethrough to remove the pull tab from the can top.
FIG. 3 is an end elevation of the pull tab can opener of FIGS. 1 and 2.

Referring to the drawings, a pull tab can opener 10 is shown mounted to a cabinet 11 underside 12 with a pair of screws 13 mounted through openings 14 in the base 15 of the pop top can opener 10. A forward ledge 16 extends around the front of the cabinet 11 front edge 17. A pair of side guides 18 and 20 are formed to the base 15 and a pair of can top guides 21 and 22 are also formed to the base 15 but inside the side guides 18 and 20. The tracks 21 and 22 have arcuate surfaces 23 thereon to guide a can top sliding thereon in a predetermined curved path as shown in FIG. 1. The pull tab grab ring catches onto a pull tab grab ring grab nook 24. The grab hook 24 is mounted to a support bracket 38 which with a pin 26 is an arcuate shaped hook having an opening therein for holding the pin 26 which pin has a torsion spring 28 wrapped therearound.

In operation, a pull tab can 31 is shown in FIG. 2A, and is placed against the top guide tracks 21 and 22 between the side guides 18 and 20 as shown in FIG. 2A and is pushed forward along the curved path 23 on the top guides 21 and 22, so that in FIG. 2B point 32 of the hook 24 grabs the grab ring 33 and bends the ring back as shown in FIG. 2C as the can is pushed forward. The hook 24 can move back until it pulls the pull tab grab ring 33 back until the pull tab 35 is bent from the can 31 top 36 as shown in FIG. 2D as the can 31 is pushed on through along the guides 21 and 22 or until the stop surface 34 reaches the surface 15. The pull tab 35 is pulled from the can as shown in FIG. 2E leaving the pull tab grab ring 33 and pull tab 35 hanging onto the hook 24 as shown in FIG. 2F with the can 31 having an opening 37 therein. On cans where the tab is depressed into the can, the tab grab hook is pulled into an upright position leaving the tab depressed into the can.

The torsion spring 28 pushes the hook 24 back forward to a rest position after the can is moved backward along curved path 23 for the next can. In this manner, the user can grasp the can 31 with one hand with the pull tab grab ring facing forward and place it on the front of the pull tab can opener 10 along the guide tracks 21 and 22 and shove it along the track with one hand to yank the pull tab off the can. Additional cans can be grabbed in rapid succession and shoved through the opener.

It should be clear at this point that a rapid commercial pull tab can opener has been provided, but it should also be clear that the present invention is not to be limited to the forms shown which are to be considered illustrative rather than restrictive.

I claim:

1. A pull tab can opener comprising:

a base;

attaching means for attaching said base to a surface;

can guiding track means formed on said base for guiding a can thereon and having a pair of can side guides and a pair of can top guides for guiding a can along a predetermined path;

a pull tab grab hook movably attached to said base between said can guiding track means, for grabbing and removing a pull tab on a can when the can is slid along said can guiding track means, whereby a pull tab can opener can be used with one hand.

2. A pull tab can opener in accordance with claim 1 in which said pull tab grab hook is spring-loaded to maintain it in a cocked position.

3. A pull tab can opener in accordance with claim 2 in which said pull tab grab hook is pinned in a bracket attached to the base of the pull tab can opener.

4. A pull tab can opener in accordance with claim 3 in which said can guiding track means, pair of can top guides are curved along a predetermined path for guiding a can along a predetermined path for driving the can pull tab grab hook into a grab ring of a pull top for pulling said pull tab from said can.

5. A pull tab can opener in accordance with claim 4 in which said attaching means includes a pair of opening in said base and a pair of screws for attaching said base to a surface.

6. A pull tab can opener in accordance with claim 5 in which said pull tab grab hook has a predetermined curve shape for engaging a pull tab can grasping ring.

* * * * *